US006729279B1

(12) United States Patent
Lundqvist et al.

(10) Patent No.: US 6,729,279 B1
(45) Date of Patent: May 4, 2004

(54) APPARATUS FOR CONTROLLING AT LEAST ONE ENGINE VALVE IN A COMBUSTION ENGINE

(75) Inventors: Ulf Lundqvist, Stockholm (SE); Johan Eriksson, Sodertalje (SE); Johan Linderyd, Sundbyberg (SE)

(73) Assignee: Scania CV AB (publ) (SE)

( * ) Notice: Subject to any disclaimer, the term of this patent is extended or adjusted under 35 U.S.C. 154(b) by 6 days.

(21) Appl. No.: 10/088,607

(22) PCT Filed: Sep. 14, 2000

(86) PCT No.: PCT/SE00/01778

§ 371 (c)(1),
(2), (4) Date: Jun. 27, 2002

(87) PCT Pub. No.: WO01/20138

PCT Pub. Date: Mar. 22, 2001

(30) Foreign Application Priority Data

Sep. 15, 1999 (SE) ..... 9903279

(51) Int. Cl.[7] ..... F01L 9/02
(52) U.S. Cl. ..... 123/90.12; 123/90.15
(58) Field of Search ..... 123/90.12, 90.15; 251/12, 21

(56) References Cited

U.S. PATENT DOCUMENTS 4,930,464 A * 6/1990 Letsche ..... 123/90.12
4,974,495 A * 12/1990 Richeson, Jr. ..... 91/459
5,012,778 A * 5/1991 Pitzi ..... 123/321
5,255,641 A 10/1993 Schechter ..... 123/90.11
5,275,136 A 1/1994 Schechter et al. ..... 123/90.12
5,456,223 A * 10/1995 Miller et al. ..... 123/90.12
5,509,383 A * 4/1996 Kahrs et al. ..... 123/90.12
5,638,781 A * 6/1997 Sturman ..... 123/90.12

FOREIGN PATENT DOCUMENTS

| | | |
|---|---|---|
| DE | 2008668 | 9/1971 |
| GB | 2224312 | 5/1990 |
| SE | 301566 | 6/1968 |
| SE | 399739 | 8/1973 |

* cited by examiner

*Primary Examiner*—Thomas Denion
*Assistant Examiner*—Ching Chang
(74) *Attorney, Agent, or Firm*—Ostrolenk, Faber, Gerb & Soffen, LLP

(57) ABSTRACT

The present invention relates to an arrangement for controlling at least one engine valve (25) of a combustion engine. The arrangement incorporates a hydraulic circuit with a pump (1), a control valve (2) which is designed to control a flow of medium in the circuit, and a power device (3) which is designed to move the engine valve (25) between open and closed positions. The pump (1) is designed to circulate a flow of medium continuously in at least part of the circuit during an operating state of the combustion engine, and the control valve (2) is designed to direct as necessary the flow of medium circulated by the pump (1) to the power device (3) so that the latter moves the motor valve (25) in a desired direction.

14 Claims, 3 Drawing Sheets

APPARATUS FOR CONTROLLING AT LEAST ONE ENGINE VALVE IN A COMBUSTION ENGINE

The present invention relates to an arrangement for controlling at least one engine valve of a combustion engine via a valve controlled hydraulic circuit.

Engine valve here means an inlet valve or exhaust valve for a combustion chamber of a combustion engine.

The movements of such engine valves are traditionally controlled by a camshaft by means of cams whose profile controls those movements, the camshaft being driven via a transmission by the engine's crankshaft. With such traditional control, many parameters which are related to the engine valves are not variable relative to one another. For example, the opening and closing times of the engine valves cannot be varied with the engine speed. An engine can therefore not be caused to achieve optimum operation throughout its speed range.

A number of mechanical systems have been developed for achieving a more flexible control of engine valves. Such systems are operationally reliable and relatively uncomplicated but do not result in fully variable control of engine valve lifting heights and opening and closing times.

Electrical systems for control of engine valves have also been developed. In such cases, engine valve movements are controlled by electromagnets. Such systems can control engine valve opening and closing times variably, but partial lifting of engine valves is difficult to achieve. It is also difficult for electromagnets to exert sufficient force to effect valve lifting when the gas pressure in the combustion chamber is high.

Finally, hydraulic control systems for engine valves are known. Hydraulic systems make it possible to vary engine valve opening and closing times and lifting heights. The known hydraulic systems operate at a substantially constant high pressure. A hydraulic pump and a pressure limiting valve are used to impart this high pressure to a hydraulic fluid which is stored in an accumulator. When an engine valve is intended to be moved to an open or closed position, a control valve is switched so that the pressurised hydraulic fluid is led into a circuit to a hydraulic cylinder in which the hydraulic fluid moves the piston. The problem with such systems is that they require a substantially constant high pressure which itself means that such a system involves a relatively high energy consumption. The high pressure and the need for the system to be completely tight entail severe requirements for the seals which form part of the system.

SUMMARY OF THE INVENTION

The object of the present invention is to provide an engine valve control arrangement which makes it possible for the engine valve opening and closing configuration to be substantially completely variable and which at the same time entails low energy consumption and does not require expensive seals.

This object is achieved with the arrangement mentioned in the introduction, which is characterised by the pump being designed to circulate a flow of medium continuously in at least part of the circuit during an operating state of the combustion engine, and by the control valve being designed to control according to need the flow of medium circulated by the pump to the power device so that the latter moves the engine valve in a desired direction. The advantage of having a continuously circulating medium flow is that the medium already has a certain velocity in the circuit. Rapid movement of the engine valve in a desired direction is achieved by directing such a medium already circulating to the power device. The pressure drop in the circuit can be kept at a low level by providing the hydraulic circuit with large flow cross-sections. The pump therefore requires relatively little energy for it to circulate the medium continuously in the circuit. As a high pressure is only required for the short periods of time when the engine valves are accelerated by the medium, the arrangement may be constructed entirely or substantially entirely without seals. In addition, components incorporated in the circuit may be manufactured with relatively large tolerances. The possible advantages include the arrangement being relatively insensitive to thermal variations and insensitive to any contaminants in the oil.

According to a preferred embodiment of the present invention, the control valve has at least two possible positions, whereby a first position results in the medium flow being led so that the power device moves the engine valve in a first direction, and a second position results in the power device moving the engine valve in a second direction. For such a control valve to function properly, it needs to be movable quickly between said two positions. The components incorporated in the circuit therefore need relatively large flow cross-sections so that a large quantity of medium can reach the power device without considerable constriction losses. With advantage, the power device incorporates a double-acting hydraulic cylinder with an internal space divided into first and second chambers by a piston which is movable within the chamber and which is connected to the engine valve, whereby the control valve in the first position is intended to lead the circulating medium to the first chamber, and in the second position to lead the circulating medium to the second chamber. The circulating medium may thus alternately be led by means of the control valve to the first and second chambers of the hydraulic cylinder in order to move in a desired direction the piston and hence the engine valve connected to the piston.

According to another preferred embodiment of the present invention, the control valve has a third possible position whereby the medium flow is intended to be directed so that it does not reach the power device. Switching the control valve from its first or second position to said third position prevents the medium reaching the first and second chambers. Movement of the piston and of the engine valve is thus halted. Preferably, the control valve in said third position also bars any flow to and from said first and second chambers. The piston and the engine valve are thus forcibly kept in their existing positions. Such switching to the third position may take place automatically when the engine valve has assumed a fully open or closed state. Alternatively, such switching may also take place when so-called partial lifting is desired, i.e. when it is not desired that the valve opens fully.

According to another preferred embodiment of the present invention, an outlet line is arranged in the cylinder and the medium flowing into the respective chamber is allowed to pass out via said outlet line when the piston has moved to a specific position in said chamber. Using such an outlet line means that the control valve requires only two positions for controlling the engine valve, thereby making it possible for the control valve to be provided with a short travel between the two positions. This may be an advantage, since the control valve has to be able to switch quickly in order, within a short space of time, to free large flow cross-sections. Such an outlet automatically establishes a circulating medium flow when the piston reaches an end position. With advantage, said outlet incorporates a throttle valve. Such a throttle valve provides the medium with a specific pressure in the outlet line. The pressure of the medium in the respective chamber in the cylinder thus becomes equal to that pressure. This medium pressure acts upon the piston so as to keep the engine valve in an open or closed position. Such a throttle valve may be settable so that the pressure in the outlet line can be varied.

According to a preferred embodiment of the present invention, the cylinder incorporates means intended to damp the piston's movement in the cylinder when, or immediately before, it reaches an end position corresponding to a fully closed or open engine valve. As the piston requires a high velocity for switching the engine valve quickly, the piston requires damping at its end positions to prevent its being subject to excessive stresses. Said damping means may include at least part of the piston being provided with a cross-sectional area which decreases towards the end of the piston and is designed to be accommodated in a recess. The steadily decreasing cross-sectional area of the piston being led into a recess results in the medium enclosed in the recess by the end of the piston passing out through an aperture with a steadily decreasing cross-sectional area. In this way the piston can be provided with damping as it reaches its end position.

According to another preferred embodiment of the present invention, the control valve is designed to be controlled by electrical signals from a control unit. The control valve may incorporate solenoids which switch the control valve to a desired position according to electrical signals received from the control unit. The control unit emitting electrical signals may be a computer unit which uses information on the respective combustion engine to control the movements of the engine valves so as to achieve as close as possible to optimum operation of the engine on the basis of various operating parameters for the engine. Examples of how the engine can be controlled include facilities for exhaust braking, for alternate operation as a two-stroke or four-stroke engine, for using so-called internal EGR (whereby exhaust gases are intended to be retained in the cylinder before the next induction stroke) and for optimised operation with regard to economy or power requirements.

According to another preferred embodiment of the present invention, a retaining device is designed to keep the engine valve forcibly in a desired position. In cases where the circulating medium does not provide sufficient force to keep the engine valve in a closed position, such a retaining device can supply supplementary force as necessary. Such a retaining device may incorporate an electromagnet.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE PRESENT INVENTION

The embodiment described below relates to a combustion engine, such as a multi-cylinder diesel engine of piston and cylinder type for use as drive engine in a heavy-duty vehicle such as a truck or a bus. As all the engine cylinders are of similar configuration, the configuration of only one of them will be described, which also means that the invention can be used in a single-cylinder engine.

Figure 1A:
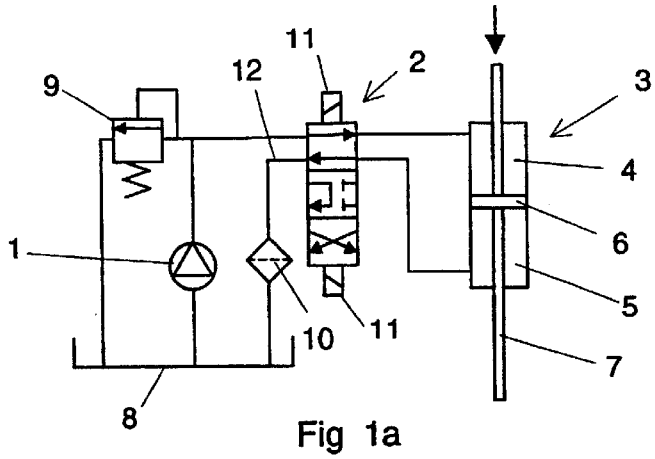
FIGS. 1*a–c* depicts a first embodiment of the present invention with a control valve in various positions.
Figure 1B:
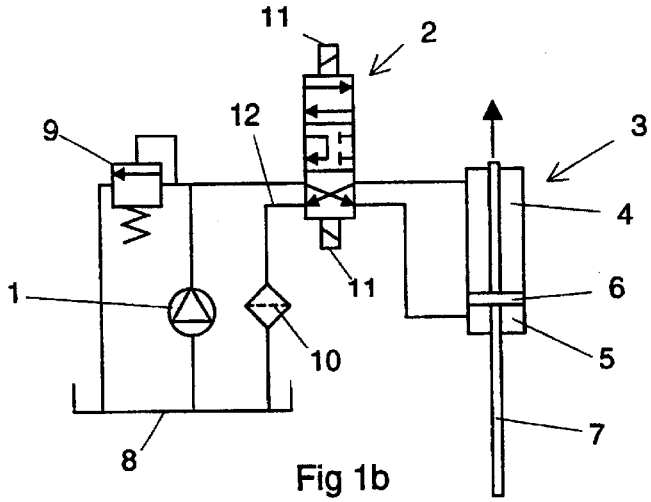
Figure 1C:
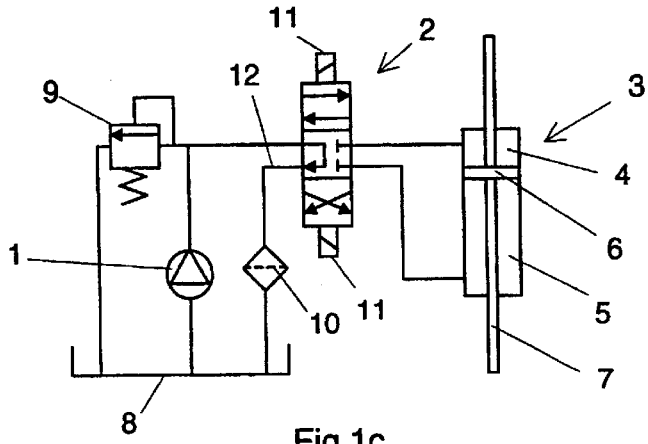

FIGS. 1*a–c* depicts a first embodiment of a hydraulic circuit designed to control an engine valve between at least an open position and a closed position. The hydraulic circuit incorporates a pump I which is designed to pump a substantially constant volume of a medium, preferably oil, in the circuit. The circuit also incorporates a control valve 2 which may be placed as necessary in three different positions. The control valve 2 may therefore lead the medium in three different directions in the circuit in order to control the movements of a double-acting hydraulic cylinder 3. The hydraulic cylinder 3 contains an internal space divided into a first chamber 4 and a second chamber 5 by a piston 6 which is movable in the chamber. The piston 6 is connected by a piston rod 7 to an engine valve which is not depicted in FIGS. 1*a–c*. The engine valve is movable by means of the hydraulic cylinder 3 between an open position and a closed position. Such an engine valve is arranged adjacent to a combustion chamber of the combustion engine. The engine valve may be an inlet valve designed to control the entry of air or a fuel/air mixture into the combustion chamber. Alternatively, the engine valve may be an exhaust valve designed to control the departure from the combustion chamber of the exhaust gases formed during the combustion process. The circuit also incorporates a medium reservoir 8 in which the medium is stored. Also arranged in the circuit are a pressure limiting valve 9 and a filter 10. The sole function of the pressure limiting valve 9 is to act as a safety valve to prevent excessive pressure occurring in the circuit as a result of any possible fault, so the pressure limiting valve 9 has no direct function in normal operation.

FIG. 1*a* shows the control valve 2 in a first position. The control valve 2 incorporates two solenoids 11 designed to move the control valves to a desired position. The solenoids 11 receive control signals from a control unit which is designed to control the engine valves so that the combustion engine achieves as close as possible to optimum operation. In this situation the medium is led from the pump 1 in the circuit through the control valve 2 to the first chamber 4 of the hydraulic cylinder 3. At the same time, the control valve 2 connects the second chamber 5 of the hydraulic cylinder 3 to the medium reservoir 8. Medium is thus allowed to flow out from the second chamber 5, via a return line 12, back to the medium reservoir 8 while at the same time medium flows into the first chamber 4. The medium inflow thus moves the piston 6 downwards in a first direction. As the piston rod 7 is connected to the engine valve, the latter also moves. The engine valve may thus be moved, for example, from a closed to an open position.

FIG. 1*b* shows the control valve 2 in a second position. In this second position, the medium flow is led from the pump 1 via the control valve 2 to the second chamber 5 of the hydraulic cylinder 3. At the same time, the first chamber 4 is connected to the return line 12 so that the medium in the first chamber 3 is led back to the medium reservoir 8. The medium flow thus moves the piston 6 upwards in FIG. 2*b*. This results in the piston rod 7 connected to the piston 6 moving the engine valve in an opposite direction to that in FIG. 1*a* The engine valve is thus moved, for example, from a fully open to a closed position.

FIG. 1*c* shows the control valve in a third position. The control valve 2 preferably assumes this third position automatically when the piston 6 has reached in the hydraulic cylinder 3 an end position corresponding to a fully closed or open engine valve. The control valve 2 may also assume this third position when so-called partial lifting is desired instead of full opening of an engine valve. When the piston 6 has reached such a position, the control valve 2 prevents further medium flow to the two chambers 4,5. At the same time, the control valve 2 retains the medium which is already in the first chamber 4 and second chamber 5. Both the piston 6 and the engine valve are thus kept forcibly in their existing positions. In the third position of the control valve, the medium is led back from the pump 1 to the medium reservoir 8 via the control valve 2 and the return line 12. Even if the piston 6 does not perform any movement, a substantially constant medium flow is thus pumped continuously in the circuit by the pump 1.

When it is desired that the engine valve should move from the position in FIG. 1*c,* an electrical control signal is led from the control unit to the solenoids 11. The solenoids 11 switch the control valve 2 to the first or second position as desired. The circulating medium, which already has a velocity in the circuit, is thus led quickly to the respective chamber 4,5 so that the desired movement of the engine valve can be achieved at a high velocity. It is advantageous to use a pump 1 which has a fixed displacement and is coupled to a crankshaft of the engine. The engine valve can thus be provided with a switching velocity proportional to the engine speed. As the pressure in the circuit is only high for the brief periods of time which correspond to the acceleration movement of the piston 6, the circuit may incorporate relatively large tolerances without entailing excessive leakage. Seals may therefore be dispensed with. The possibility of having relatively large tolerances reduces the purity requirements for the medium. This makes it possible, for example, to use motor oil as the medium, and for the medium reservoir 8 to take the form of an existing oil sump.

Figure 2:
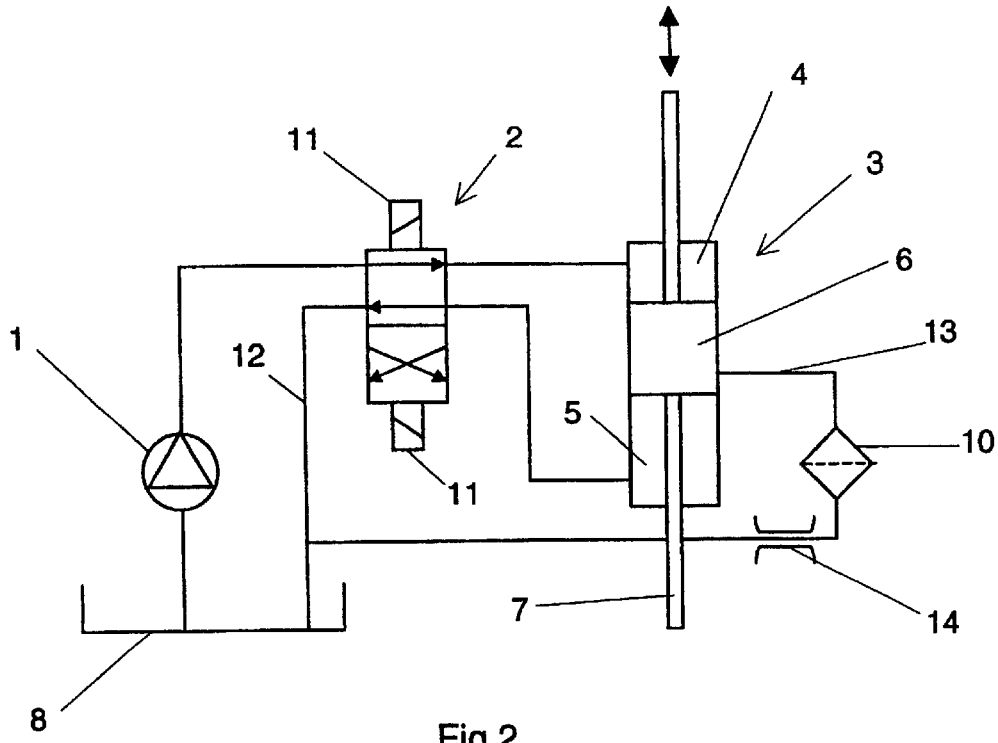
FIG. 2 depicts schematically a second embodiment of the present invention.

FIG. 2 depicts schematically another embodiment of the arrangement. In this case a pump 1 leads a flow of medium to a control valve 2 which has two possible positions. After passing through the control valve 2, the medium may alternatively be led to a first chamber 4 or a second chamber 5. At the same time, the chamber 4,5 which is not supplied with the medium is connected to a return line 12 which leads the medium back to the medium reservoir 8. Moving the control valve 2 to the first or second position results in movement of a piston 6 which separates said chambers 4,5. The piston 6 is provided with a piston rod 7 which is connected to an engine valve not depicted in FIG. 2. The hydraulic cylinder 3 also incorporates an outlet line 13. The outlet line 13 is positioned so as to be alternatively connected to the first chamber 4 or the second chamber 5 immediately before the piston 6 in the cylinder 3 reaches an end position which corresponds respectively to a fully closed or open engine valve. When the respective chamber 4,5 is connected to the outlet line 13, the medium flows out of that chamber 4,5 via the outlet line 13. Such an outlet line 13 reduces the pressure of the medium on the piston 6 immediately before the latter reaches its end position. The velocity of the piston 6 is thus decelerated. The outlet line 13 incorporates a throttle valve 14 designed to maintain a desired pressure of medium in the outlet line 13. This also results in a corresponding pressure in the respective chamber 4,5. The force which holds the piston 6 and the engine valve in a closed or open position can therefore be regulated by the throttle valve. When the piston 6 has reached an end position and comes to a halt, the pump 1 thus continues to circulate the medium in the circuit. In this situation the medium passes through the first chamber 4 or second chamber 5 of the hydraulic cylinder 3 and through the outlet line 13 to the medium reservoir 8 via the filter 10 and the throttle valve. When engine valve movement in an opposite direction is desired, the control unit sends an electrical control signal to the solenoids 11, which switch the control valve 2. Circulating medium is thus led from the pump 1 via the control valve 2 to the respective chamber 4,5. This medium flow causes the piston 6 and hence the engine valve to move in a desired direction.

FIGS. 3*a–d* shows in more detail a possible configuration of the arrangement in FIG. 2. A pump 1 circulates a medium from a medium reservoir 8 to a control valve 2 which can be moved to first and second positions. The control valve 2 contains an internal space delineated by a first piston 15, a second piston 16 and a third piston 17. These three pistons 15, 16, 17 are firmly connected to a movable piston rod 18. The medium has two alternative inlets to and three outlets from the control valve 2. A first outlet incorporates a first line 19 connected to a first chamber 4 of the hydraulic cylinder 3. A second outlet incorporates a second line 20 connected to a second chamber 5 of the hydraulic cylinder 3. A third outlet incorporates a third line 12 which leads the medium back to the medium reservoir 8. The hydraulic cylinder 3 incorporates a piston 6 which comprises an upper piston portion 21 and a lower piston portion 22. The upper and lower piston portions 21 and 22 respectively exhibit cross-sectional areas which decrease towards the end surfaces of the piston 6. The hydraulic cylinder 3 incorporates an upper recess 23 and a lower recess 24 which are respectively designed to accommodate said upper and lower piston portions 21 and 22. The piston 6 incorporates a piston rod 7, the lower end of which is connected to an engine valve 24. The hydraulic cylinder 3 incorporates an outlet line 14 with a throttle valve 14.

Figure 3A:
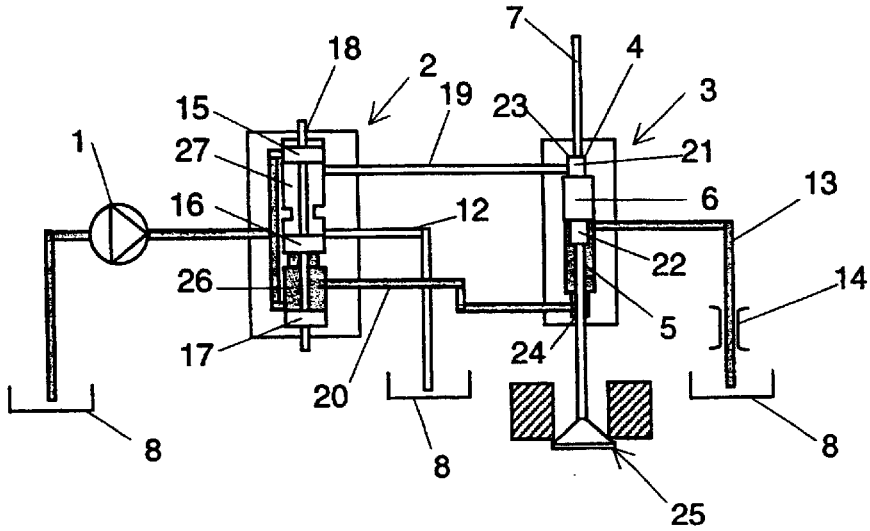
FIGS. 3*a–d* depicts in more detail how the arrangement in FIG. 2 may be implemented.

FIG. 3*a* shows the lines carrying the medium flow in the circuit shaded, with a fully closed engine valve and a control valve 2 in a second position. In this case the medium is led from the medium reservoir 8 by means of the pump 1 via the lower inlet to a lower chamber 26 in the control valve 2. The upper piston 15 prevents the medium from being led into an upper chamber 27 of the control valve 2. After passing through the lower chamber 26, the medium is led through the second line 20 to the second chamber 5 of the hydraulic cylinder 3. In this situation the piston 6 is in its upper end position. The second chamber 5 is therefore connected to the outlet line 13. The medium flowing into the chamber 5 passes on out through the outlet line 13, via the throttle valve 14, back to the medium reservoir 8. The pressure of the medium in the outlet line 13 is determined by the throttle valve 14. The same pressure prevails in the second chamber 5 and also determines the force which keeps the engine valve 25 in a closed position.

Figure 3B:
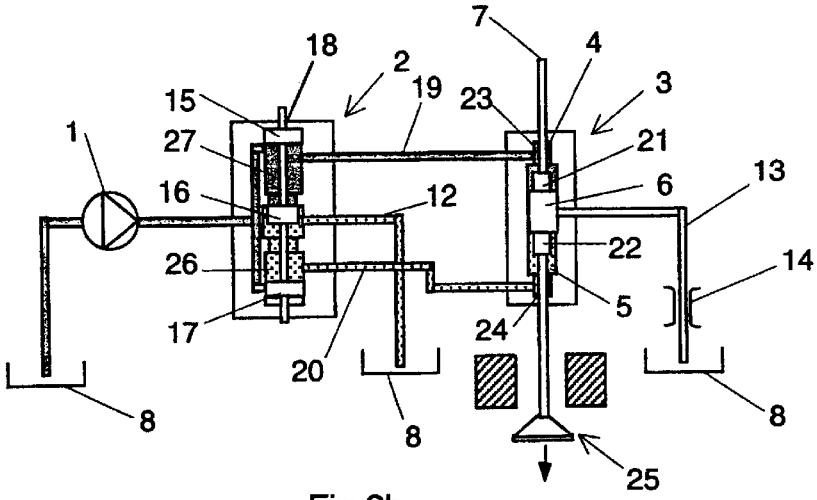

In FIG. 3*b* the control valve 2 has moved to a first position. The circulating medium is led, as illustrated by the shading, from the pump 1 to the upper chamber 27 in the control. valve 2. The piston 17 prevents the medium from being led into the lower chamber 26. From the upper chamber 27, the medium passes through the first line 19 to the first chamber 4 of the hydraulic cylinder 3. The medium flowing into the first chamber 4 pushes the piston 6 downwards and hence also moves the valve 25 from a closed to an open position. The control valve 2 in this first position allows the medium in the second chamber 5 of the hydraulic cylinder 3 to be led back through the second line 20 via the lower space 26 in the control valve 2 to the return line 12 and the medium reservoir 8. This medium flow is illustrated by the dotted portions of FIG. 3*b*.

Figure 3C:
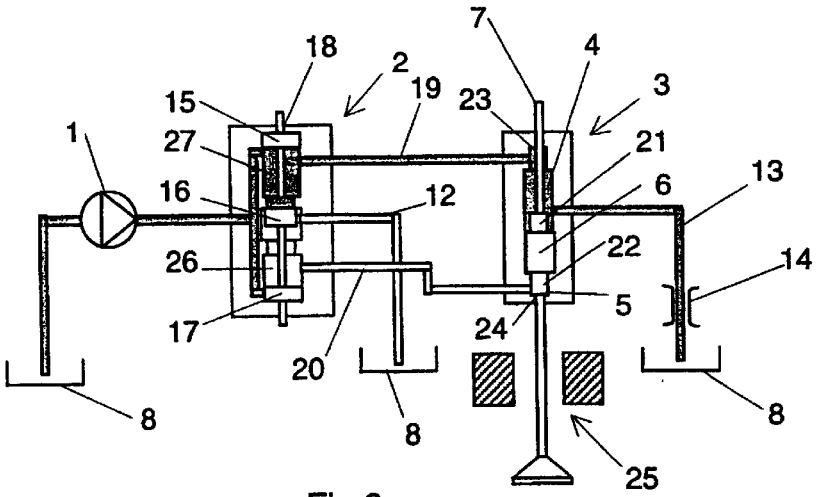

In FIG. 3*c* the engine valve 25 has reached its fully open position. The medium in the first chamber 4 of the hydraulic cylinder 3 has now been connected to the outlet line 13. The medium flowing to the chamber 4 is led through the outlet line 13 and the throttle valve 14 back to the medium reservoir 8. The connection to the outline line 13 opened substantially immediately before the piston 6 reached its lower end position. A comparison of FIGS. 3*a* and 3*c* shows that the outlet line 13 is so positioned and the piston 6 and its cylinder 3 are so shaped that the piston 6 moves through the cylinder 3 and past the outlet line 13 selectively toward one side of the line 13 and toward an opposite side of the line 13 for selectively communicating the outlet line 13 with the first chamber 4 or the second chamber 5 of the cylinder 3. The medium being allowed to pass through the outlet line 13 has reduced the pressure of medium on the piston 6. The velocity of the piston 6 was therefore decelerated before it reached its lower end position. The piston 6 exhibits a lower piston portion 22 with cross-sectional area which decreases towards the end of the piston. The lower piston portion 22 is designed to be accommodated in a lower recess 24 in the cylinder 3 before the piston reaches said end position. The medium which is in the recess 24 will therefore be forced upwards and will pass through a gap with a steadily decreasing cross-section. The velocity of the piston 6 is thus also damped in this way before the piston 6 reaches its end position with an engine valve in a fully open position.

Figure 3D:
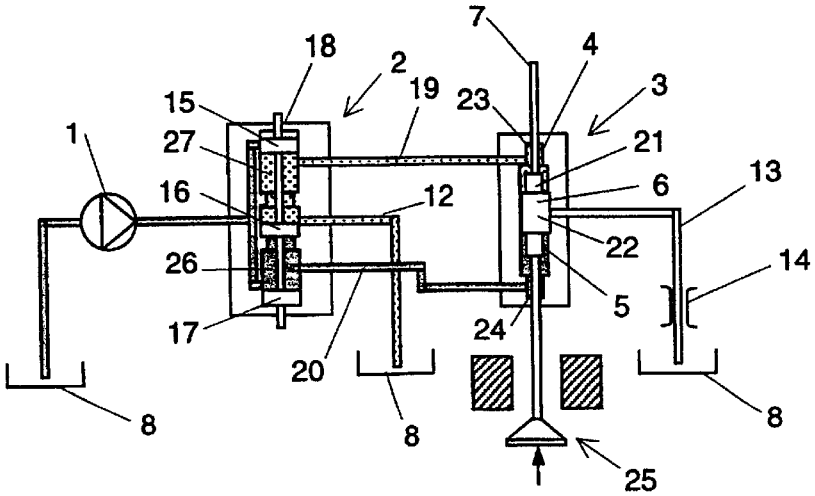

In FIG. 3*d* the control valve 2 has reverted to its second position. The medium is led back from the pump 1 to the lower space 26 of the control valve 2. Thereafter the medium is led through the second line 20 to the second space 5 of the hydraulic cylinder 3. At the same time, the control valve 2 allows the medium in the first chamber 3 (dotted areas) to pass via the first line 19 and the upper space 27 of the control valve 2 to the return line 12 and the medium reservoir 8. In this situation the engine valve 25 has moved towards a closed piston 6. When the engine valve 25 has reached a fully closed position, the process can continue as depicted in FIG. 3*a*.

The present invention is in no way limited to the embodiments depicted in the drawings but may be varied freely within the scopes of the patent claims.

What is claimed is:

1. An arrangement for controlling an engine valve of a combustion engine comprising:

the engine valve being movable between a valve closed and a valve opened condition;

a piston connected with the engine valve for moving the engine valve between the valve closed and the valve opened conditions;

a cylinder through which the piston is movable and the piston dividing the cylinder into first and second chambers defined at opposite sides of the piston;

a loop hydraulic circuit; a pump in the hydraulic circuit which operates for pumping a hydraulic medium in a continuous flow through the hydraulic circuit in one direction;

a control valve in the hydraulic circuit, the control valve being operable between a control valve first position and a control valve second position;

in the control valve first position, a first fluid medium flow current is opened past the control valve to the first chamber for delivering the hydraulic medium to the first chamber and a second fluid medium flow current of the hydraulic medium is opened from the second chamber past the control valve for permitting exit of the hydraulic medium from the second chamber, whereby flow of the hydraulic medium into the first chamber moves the piston to move the engine valve to the open condition; the pump having an inlet disposed for receiving hydraulic medium which exits from the second chamber and in the control valve second position, a third fluid medium flow current of the hydraulic medium is opened past the control valve to the second chamber for delivering hydraulic medium to the second chamber and a fourth fluid medium current of the hydraulic medium is opened from the first chamber past the control valve for permitting exit of the hydraulic medium from the first chamber, whereby flow of the hydraulic medium into the second chamber moves the piston to move the engine valve to the closed condition; the pump inlet being disposed for receiving hydraulic medium which exits from the first chamber;

whereby operation of the control valve between the control valve first and second positions respectively directs the continuous flow of medium into the first chamber and into the second chamber in the control valve first and second positions, respectively.

2. The arrangement of claim 1, wherein the piston in the power device is movable through the cylinder of the power device between end positions of movement;

damping devices in the power device shaped and positioned for damping movement of the piston in the cylinder of the power device as the piston is reaching end positions in the cylinder which correspond to the fully closed or fully opened engine valve positions.

3. The arrangement of claim 1, wherein the damping devices comprise each end of the piston having a reduced cross-sectional area, and the cylinder at each end of the piston having a recess shaped and adapted to receive the reduced cross-sectional area of the piston as the piston moves toward each end.

4. The arrangement of claim 1, wherein the control valve is operable by electrical signals; and a control unit connected with the control valve for electrically controlling the controlled valve.

5. The arrangement of claim 1, wherein the control valve has a third position wherein the fluid circuit passes into and out of the control valve and the control valve blocks communication of the medium to and from both of the first and second chambers of the cylinder.

6. The arrangement of claim 1, further comprising a drain for the medium from the cylinder, the drain being so positioned and the piston and the cylinder being so shaped that the piston moves through the cylinder and past the drain selectively toward one side of the drain and toward an opposite side of the drain for selectively communicating the drain with the first chamber and the second chamber, respectively.

7. The arrangement of claim 6, wherein the piston is so shaped with respect to the drain as to have a position in the cylinder where the piston blocks exit of medium from the drain.

8. The arrangement of claim 7, further comprising a settable throttle in the drain controlling the flow of medium through the drain.

9. The arrangement of claim 1, wherein the control valve comprises an axially shiftable valve body in a cylinder, the cylinder and the valve body being shaped to define passages past the valve body, and the passages being alignable with the circuit for supplying medium to the first chamber with the control valve in the first position and the valve body in a first position thereof and for supplying medium to the second chamber with the control valve in the second position and the valve body in a second position thereof.

10. The arrangement of claim 1, further comprising a reservoir for hydraulic medium disposed for receiving hydraulic medium which exits from the first and the second chambers, and the pump inlet communicating into the reservoir.

11. The arrangement of claim 6, further comprising a reservoir for hydraulic medium and disposed for receiving hydraulic medium from the drain; and the pump inlet communicating into the reservoir.

12. An arrangement for controlling an engine valve of a combustion engine comprising:

the engine valve being movable between a valve closed and a valve opened condition;

a piston connected with the engine valve for moving the engine valve between the valve closed and the valve opened conditions;

a cylinder through which the piston is movable and the piston dividing the cylinder into first and second chambers defined at opposite sides of the piston;

a hydraulic circuit; a pump in the hydraulic circuit which operates for pumping a hydraulic medium continuously through the hydraulic circuit in one direction;

a control valve in the hydraulic circuit, the valve being operable between a control valve first position and a control valve second position;

in the control valve first position, a first fluid medium flow current is opened past the control valve to the first chamber for delivering the hydraulic medium to the first chamber and a second fluid medium flow current of the hydraulic medium is opened from the second chamber past the control valve for permitting exit of the hydraulic medium from the second chamber, whereby flow of the hydraulic medium into the first chamber moves the piston to move the engine valve to the open condition; and in the control valve second position, a third fluid medium flow current of the hydraulic medium is opened past the control valve to the second chamber for delivering hydraulic medium to the second chamber and a fourth fluid medium current of the hydraulic medium is opened from the first chamber past the control valve for permitting exit of the hydraulic medium from the first chamber, whereby flow of the hydraulic medium into the second chamber moves the piston to move the engine valve to the closed condition;

whereby operation of the control valve between the control valve first and second positions respectively directs the continuous flow of medium into the first chamber and into the second chamber in the control valve first and second positions, respectively;

a drain for the medium from the cylinder, the drain being so positioned and the piston and the cylinder being so shaped that the piston moves through the cylinder and past the drain selectively toward one side of the drain and toward an opposite side of the drain for selectively communicating the drain with the first chamber and the second chamber, respectively.

13. The arrangement of claim 12, wherein the piston is so shaped with respect to the drain as to have a position in the cylinder where the piston blocks exit of medium from the drain.

14. The arrangement of claim 13, further comprising a settable throttle in the drain controlling the flow of medium through the drain.

* * * * *